United States Patent [19]

Saeki

[11] Patent Number: 4,864,366

[45] Date of Patent: Sep. 5, 1989

[54] AUTOMATIC DOCUMENT FEEDER

[75] Inventor: Shiro Saeki, Yokohama, Japan

[73] Assignee: Ricoh Company, Ltd., Tokyo, Japan

[21] Appl. No.: 199,869

[22] Filed: May 27, 1988

[30] Foreign Application Priority Data

May 29, 1987 [JP] Japan ..... 62-135406

[51] Int. Cl.[4] ..... G03G 15/00; B65H 9/00; B65H 9/10

[52] U.S. Cl. ..... 355/235; 355/308; 355/317; 271/226; 271/233

[58] Field of Search ..... 355/14 R, 8, 14 SH, 355/3 SH, 23–25, 48, 50, 55, 61; 271/226, 227, 228, 233, 238, 256, 258, 259, 265

[56] References Cited

U.S. PATENT DOCUMENTS 4,419,007 12/1983 Kingsley .
4,457,506 7/1984 Ashbee et al. .
4,563,079 1/1986 Inuzuka et al. ..... 355/14 R
4,579,326 4/1986 Pinckney et al. .
4,610,533 9/1986 Takahata ..... 271/265 X
4,710,018 12/1987 Miyaji ..... 355/14 R
4,723,772 2/1988 Honjo et al. .
4,763,160 8/1988 Honjo ..... 355/3 SH
4,771,317 9/1988 Katoh et al. ..... 355/8

*Primary Examiner*—A. T. Grimley
*Assistant Examiner*—Edward Pipala
*Attorney, Agent, or Firm*—Oblon, Spivak, McClelland, Maier & Neustadt

[57] ABSTRACT

An automatic document feeder for feeding documents in order to expose a document in a sheet through mode in which an optical system is fixed, a document is moved at constant speed, including; rollers for feeding documents one at a time from a document feeder table to a constant glass plate of a copy machine, a senser for sensing the length of the document, a scale disposed at an end of the contact galss plate at which the document is fed, and a controller for moving the exposure position of the optical system.

5 Claims, 2 Drawing Sheets

AUTOMATIC DOCUMENT FEEDER

BACKGROUND OF THE INVENTION

The present invention relates to automatic document feeders.

When copies each are to be obtained from a corresponding one of a plurality of sheet documents, an automatic document feeder (ADF) is used which feeds the documents automatically one at a time onto a contact glass plate of the copy machine, exposes the fed document and then discharges the exposed document to a document receiver. When a plurality of copies is to be obtained from each of a plurality of documents, a recirculating automatic document feeder (RADF) is used in which the exposed document at ADF is returned to the document feeder table and stacked on the previously stacked documents and such circulation of the document is repeated automatically a desired number of times. There are two types of document feeding methods performed by ADFs inclusive of RADFs, one being an upside-down feeding method in which documents are stacked in sequence of pages on the document feeder table with their images facing upwardly, turned upside down one at a time and fed to the contact glass table of the copy machine, starting with the lowest final page, and another being a normal feeding method in which documents are to set on the document feeder table with their images facing downwardly and fed one at a time, starting with the lowest first page. Some of the former type employing a sheet through mode are introduced in which a document is exposed by a fixed optical system while being moved in order to increase the number of copies per minutes (CPM). Among the latter methods, no one is found which employs a sheet through mode to expedite high speed copying.

FIG. 1 shows a document feeding method using one example of the ADFs of the upside-down feeding type. Documents are stacked on a document feeder table 101 provided above a contact glass plate 100 such that the images face upwardly, sequentially turned upside down one at a time, starting with the lowest one, and fed to the contact glass plate 100, hit at its leading end on a reference 102 provided at the front end of the contact glass plate 100 to correct a skew in the document. The document is then exposed by moving an optical system, or otherwise the document is moved in the direction opposite to the feeding direction and exposed by a fixed optical system. The exposed document is carried in the reverse direction, discharged from the inlet side of the contact glass plate 100, turned upside down and discharged onto a document still present on the document feeder table 101 via discharge rollers 103. In that case, since the next document cannot be inserted onto the contact glass plate 100 until the exposed document is completely discharged out of the glass plate 100, the time when the feeding of a document starts is restricted, the intervals at which documents are fed are large and CPM is not improved. If a document is intended to be moved in the feeding direction on the contact glass plate 100 in a sheet through mode and exposed, the leading end of the document cannot be hit on the reference 102, so that no skews in the document can be corrected and the copy quality is deteriorated. Some of the upside-down feeding type which provides copies in a sheet through mode cannot free a document under exposure and is likely to cause uneven feeding and hence a defective image.

The sheet through exposure has been considered to be difficult in an ADF of the normal feeding type. The reason for this is that if the exposure position is set at the inlet end Pl of the contact glass plate 100, as shown in FIG. 2, the trailing end of the document under exposure will be at the separating and feeding section and the document feeder table, so that it is difficult to maintain the moving speed of the document constant due to a load due to the separation of the document and the weight of the bundle of documents 104 itself and thus to provide a good image. Second, when the exposure position is set in the vicinity of the front end P2 of the contact glass plate 100, the distance between the exposure position and a sensor 7 which determines the timing with which a sheet of transfer paper is fed is large and it is difficult to cause the leading ends of the sheet of transfer paper and image to coincide.

In view of the above prior art AFDs' problems, it is an object of the present invention to provide an ADF of a normal feeding type ADF which has a relatively simple mechanism which is capable of correcting a skew in the document even in a sheet through mode, minimizes the intervals at which a document is fed irrespective of the document size, greatly improves CPM and improves an image obtained under sheet through exposure.

SUMMARY OF THE INVENTION

The above mentioned object of the present invention is achieved by an automatic document feeder for feeding documents in order to expose a document in a sheet through mode in which an optical system is fixed, a document is moved at constant speed, comprising;

a feed means for feeding documents one at a time from a document feeder table to a contact glass plate of a copy machine, a discharge means for moving said exposed document in the direction of document feeding and discharging said document out of said contact glass plate, a sensing means for sensing the length of said document fed onto said contact glass plate, a scale means disposed at an end of said contact glass plate at which said document is fed, and a control means for moving said exposure position of said optical system where said document is exposed, in accordance with said length of said document in said sheet through mode, such that the distance between said scale and said exposure position is a short constant length longer than said length of said document sensed by said sensing means, temporarily moving backwardly said document fed onto said contact glass plate such that said trailing end of the document hits on said scale, and carrying said document at constant speeds in said direction of document feeding.

According to the present invention, sheet through exposure is possible even in an ADF of the normal feeding type and the intervals at which a document is fed are minimized, so that CPM is greatly improved. During the sheet through exposure, the document is completely separated away from the separating and feeding unit and the document feeder table, so that double feeding of documents and the conveyance load due to the weight of a bundle of the documents itself are eliminated. Thus the moving speed of a document is easily maintained constant to thereby provide a good image.

DETAILED DESCRIPTION OF THE INVENTION

An embodiment of the present invention will now be described in more detail with reference to the drawings.

The present invention should not be taken as being restricted to the above embodiment. Various changes and modifications are possible to those skilled in the art without departing from the spirit and scope of the present invention.

Figure 1:
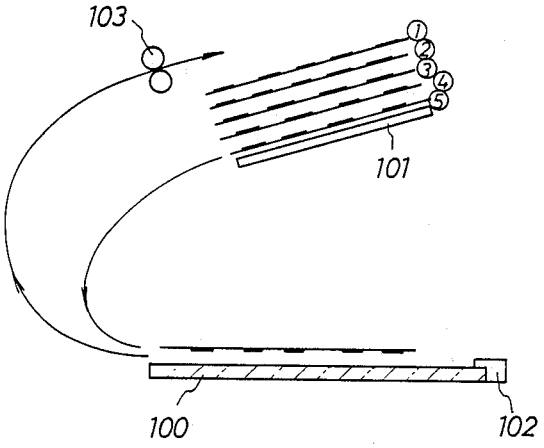
FIG. 1 illustrates one example of a conventional ADF of the upside-down feeding type.
Figure 2:
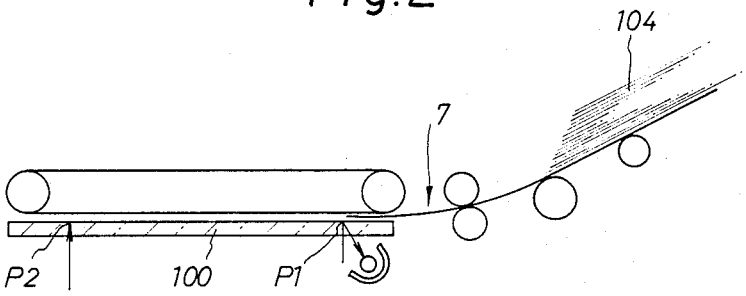
FIG. 2 illustrates another example of a conventional ADF of the normal feeding type ADF.
Figure 3:
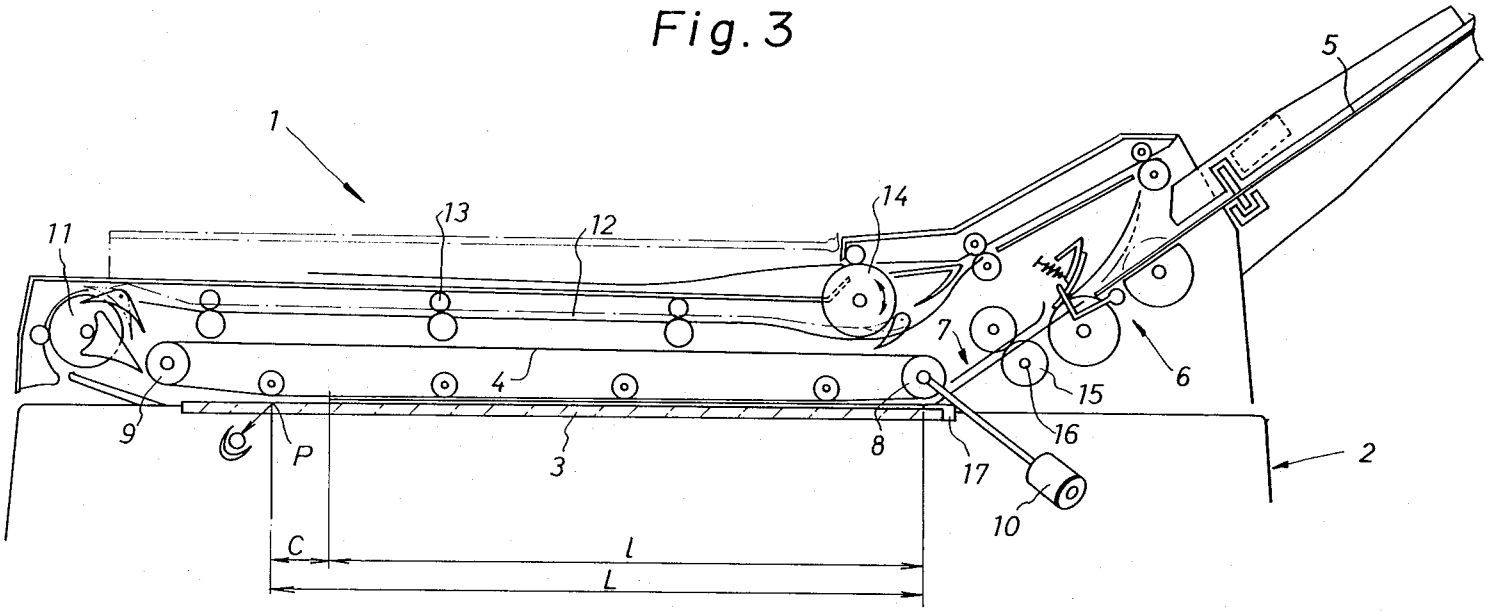
FIG. 3 is a side cross section view of an embodiment of the present invention.

Referring to FIG. 3, a recirculing automatic document feeder (RADF) 1 is mounted such that a lower side of a conveyor belt 4 contacts a contact glass plate 3 of a copy machine 2. A document table 5 is provided at the right side of RADF 1. A separating and feeding means 6 is provided which feeds onto the contact glass plate 3 documents stacked on the table 5 with the document images facing downwardly, one at a time, starting with the lowest one. A paper sensor 7 is provided at the inlet to the belt 4 which extends around a drive roller 8 and a follower roller 9 such that a drive motor 10 drives the roller 8 to carry a document fed into the space between the roller 8 and the contact glass plate 3 along the upper surface of the glass plate 3.

An exposure optical system (not illustrated) is provided under the contact glass plate 3. At scan exposure, a document fed onto the contact glass plate 3 and stopped at a predetermined position is scanned at predetermined speeds for exposing purposes. The exposed document is discharged by the conveyor belt 4 and inverted by an inverting roller 11, carried along a return conveyor path 12 provided above the belt 4 by pairs of rollers 13 provided at appropriate spacings, inverted by an inverting roller 14, as needed, or returned to the bundle of documents placed on the document table 5 without being inverted.

The structure and operation of the apparatus described so far are not essentially different from those of the conventional RADF. In the particular embodiment, however, document exposure is possible in a sheet through mode, the exposure position P of the exposure optical system is movable at constant speed such that the exposure optical system can scan for exposure purposes in a normal scan mode, or otherwise exposure possible is by keeping the exposure optical system stationary at a position.

In order to sense the length of a document fed onto the contact glass plate 3 in the feeding direction, an encoder (not illustrated) is attached to a shaft 16 of a pull-out follower roller 15 in the document feeder. The encoder counts pulses produced when the sensor 7 continues to detect from the leading end of a document to the trailing end of the document to determine the length of the document in the feeding direction.

In FIG. 3, a skew correcting scale 17 is provided at the right end of the contact glass plate 3. A skew in the document is corrected by causing the document moving reversely on the glass plate 3 to hit at its trailing end on the scale 17. The exposure position P in a sheet through mode is controlled such that the distance L between the exposure position P and the scale 17 is a short constant length C longer than the length l of a document sensed and determined by the sensor 7 and the encoder.

The operation of RADF in the sheet through mode will now be described. The lowest document of a bundle of documents placed on the document feeder table 5 is separated and fed by predetermined operations at predetermined speeds to the contact glass plate 3 in accordance with a signal from the copy machine proper. At this time, the length of the document fed in the feeding direction is determined by the sensor 7 and the encoder provided at the roller shaft 15.

After the trailing end of the document is sensed by the sensor 7, an encoder (not illustrated) within the motor 10 starts to count pulses, the motor 10 is reversed when the count reaches a predetermined value, thereby reversing the document, and thereafter the trailing end of the document hits on the scale 17 to correct a skew in the document. A determination signal indicative of the length of the document sensed by the sensor 7 and the encoder is transmitted to the copy machine proper and the exposure position P of the optical system is moved to the aforementioned position in accordance with the length of the document.

A few miliseconds after the trailing end of the documents hits on the scale 17, the motor 10 again starts to rotate in the feeding direction, and the image forming process and transfer paper feeding process are performed synchronously with the starting of the motor in the feeding direction. Since the distance C between the leading end of the document and the exposure position P is constant irrespective of the length of the document, the exposure leading position, the image forming position on the photosensitive material, and the leading position of the transfer paper are completely registered.

The following document is separated and fed at a low speed, and maintained at a constant interval. A few milliseconds after the first document is exposed, the motor 10 and thus the conveyor belt 4 are reversed, the second document is hit at its trailing end on the scale 17, a predetermined time after which the motor 10 is rotated forwardly to thereby repeat the sheet through exposure.

Since in this apparatus the length of a document is accurately sensed at the document feeding, the timings with which the next document starts to be fed, and the belt 4 is switched between the forward and backward movements are set in accordance with the sensed document length.

The exposed document is carried along the return conveyor passageway 12. In the case of a single-sided printed document, the document is turned upside down by the inverting roller 14 while in the case of a two-sided printed document, the document is discharged onto a bundle of documents on the document table 5 without being inverted.

In the scan exposure mode, a document is carried to a predetermined position on the contact glass plate 3 at high speeds and then stops, the scanner moves at predetermined speeds to thereby perform an exposure scanning.

What is claimed is:

1. An automatic document feeder for feeding documents in order to expose a document in a sheet through mode in which an optical system is fixed, a document is moved at constant speed, comprising;

a feed means for feeding documents one at a time from a document feeder table to a contact glass plate of a copy machine, a discharge means for moving said exposed document in the direction of document feeding and discharging said document out of said contact glass plate, a sensing means for sensing the length of said document fed onto said contact glass plate, a scale means disposed at an end of said contact glass plate at which said document is fed, and a control means for moving said exposure position of said optical system where said document is exposed, in accordance with said length of said document in said sheet through mode, such that the distance between said scale and said exposure position is a short constant length longer than said length of said document sensed by said sensing means, temporarily moving backwardly said document fed onto said contact glass plate such that said trailing end of the document hits on said scale, and carrying said document at constant speeds in said direction of document feeding.

2. The feeder of claim 1, in which said feed means comprises a roller for feeding said documents, said sensing means comprising a paper sensor detecting a leading end of said document and a trailing end of said document, and an encoder provided at said roller.

3. The feeder of claim 2, in which said feeding means is adapted to be reversed when a predetermined time passes after said trailing end of said document is sensed by said paper sensor.

4. The feeder of claim 1, in which an inverting means is disposed at a downstream side of said exposure position for inverting upside down said exposed document.

5. The feeder of claim 1, in which said exposure position is adapted to be controlled such that a distance between said exposure position and said scale means is said short constant length longer than said length of said document sensed by said sensing means.

* * * * *